US011458411B1

(12) United States Patent
Thai

(10) Patent No.: US 11,458,411 B1
(45) Date of Patent: Oct. 4, 2022

(54) BUBBLE MACHINE FOR PRODUCING VERTICAL BUBBLES

(71) Applicant: Placo Bubbles Limited, TST East (HK)

(72) Inventor: Douglas Thai, TST East (HK)

(73) Assignee: Placo Bubbles Limited, Hong Kong (HK)

( * ) Notice: Subject to any disclaimer, the term of this patent is extended or adjusted under 35 U.S.C. 154(b) by 0 days.

(21) Appl. No.: 17/380,894

(22) Filed: Jul. 20, 2021

(51) Int. Cl.
*A63H 33/28* (2006.01)

(52) U.S. Cl.
CPC ..... *A63H 33/28* (2013.01)

(58) Field of Classification Search
CPC ..... A63H 33/28
See application file for complete search history.

(56) References Cited

U.S. PATENT DOCUMENTS

| | | | | |
|---|---|---|---|---|
| 2,412,732 | A * | 12/1946 | Holman | A63H 33/28 D21/402 |
| 2,452,794 | A * | 11/1948 | Saachy | A63H 33/28 446/16 |
| 2,632,281 | A * | 3/1953 | Schmidt, Jr. | A63H 33/28 446/16 |
| 8,272,915 | B2 * | 9/2012 | Thai | A63H 33/28 446/16 |
| 8,272,916 | B2 * | 9/2012 | Thai | A63H 33/28 446/16 |
| 9,339,737 | B2 * | 5/2016 | Chan | A63H 33/28 |
| 10,363,492 | B1 * | 7/2019 | Thai | A63H 33/28 |
| 10,434,434 | B1 * | 10/2019 | Thai | A63H 29/22 |
| 10,702,787 | B2 | 7/2020 | Thai | |
| 10,702,788 | B2 * | 7/2020 | Thai | A63H 33/28 |
| 10,814,243 | B2 * | 10/2020 | Clayton | A63H 33/28 |
| 2003/0116224 | A1 * | 6/2003 | Crawford | A63H 33/28 141/352 |
| 2015/0133021 | A1 * | 5/2015 | Huey | A63H 33/28 446/15 |

(Continued)

FOREIGN PATENT DOCUMENTS

| | | | | |
|---|---|---|---|---|
| DE | 1933748 | A1 * | 1/1971 | A63H 33/28 |

OTHER PUBLICATIONS

Loefflad, machine translation of DE1933748A1, uploaded Aug. 2, 2022, Espacenet, 2 pages.*

*Primary Examiner* — Eugene L Kim
*Assistant Examiner* — Matthew B Stanczak
(74) *Attorney, Agent, or Firm* — Raymond Sun

(57) ABSTRACT

A bubble machine has a fan housing that is positioned inside a machine housing, and a fan coupled to the fan housing. A bubble dispenser is disposed over the machine housing and has an outer wall that defines a trough along a portion of its circumferential edge. The bubble dispenser includes an inner hub having a raised platform, and a bubble wand guiding mechanism on the platform. The outer wall and the inner hub define at least one space through which air generated by the fan can flow upwardly. A bubble wand assembly has a base, and a plurality of bubble wands that are disposed above the bubble dispenser in a manner such that each of the plurality of bubble wands is rotated past the trough to be coated with bubble solution, and then rotated over the at least one space so that air from below can be blown through the bubble wand to generate bubbles.

7 Claims, 9 Drawing Sheets

(56) References Cited

U.S. PATENT DOCUMENTS

| | | | | |
|---|---|---|---|---|
| 2015/0265940 | A1* | 9/2015 | Chan | A63H 33/28<br>446/16 |
| 2020/0061487 | A1* | 2/2020 | Thai | A63H 33/28 |
| 2020/0155957 | A1* | 5/2020 | Clayton | A63H 33/28 |
| 2021/0129040 | A1* | 5/2021 | Chan | A63H 33/28 |
| 2021/0260496 | A1* | 8/2021 | Yang | A63H 33/28 |

* cited by examiner

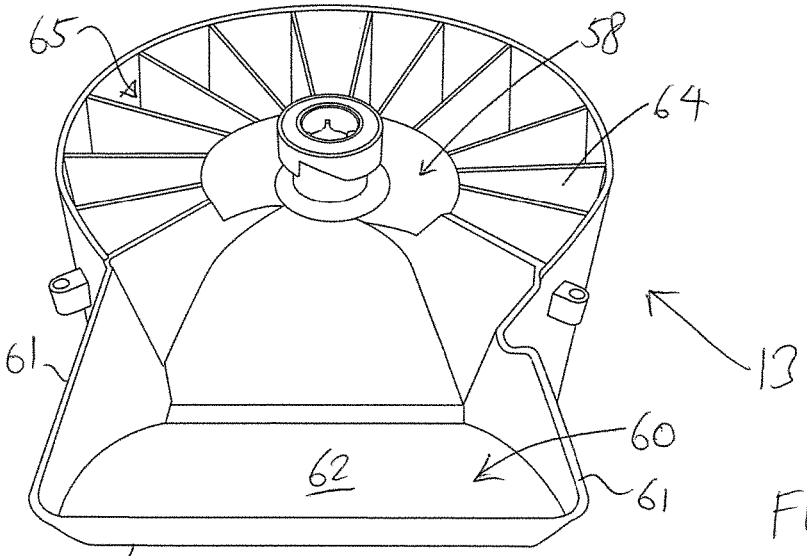
FIG. 5
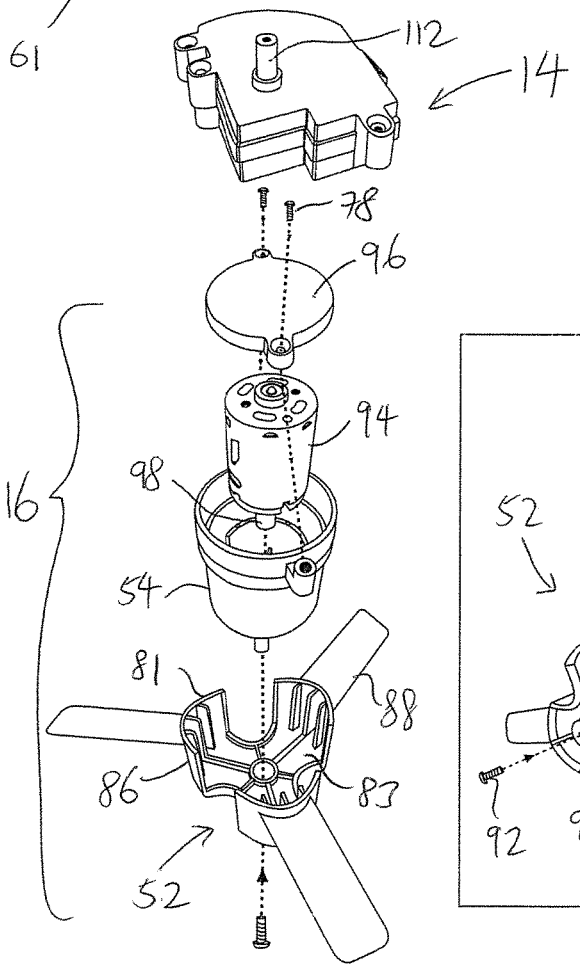
FIG. 6
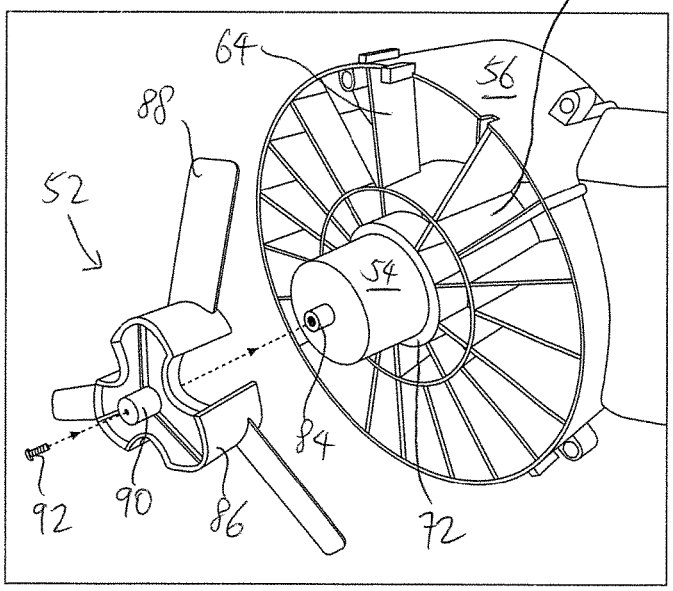

BUBBLE MACHINE FOR PRODUCING VERTICAL BUBBLES

BACKGROUND OF THE INVENTION

1. Field of the Invention

The present invention relates to bubble toys, and in particular, to a bubble generating machine which automatically generates a plurality of bubbles at the same time and emits them upwardly in a vertical manner.

2. Description of the Prior Art

Bubble producing toys are very popular among children who enjoy producing bubbles of different shapes and sizes. Many bubble producing toys have previously been provided. Perhaps the simplest example has a stick with a circular opening or ring at one end, resembling a wand. A bubble solution film is produced when the ring is dipped into a dish that holds bubble solution or bubble producing fluid (such as soap) and then removed therefrom. Bubbles are then formed by blowing carefully against the film. Such a toy requires dipping every time a bubble is to created, and the bubble solution must accompany the wand from one location to another.

Recently, the market has provided a number of different bubble generating assemblies that are capable of producing a plurality of bubbles. Examples of such assemblies are illustrated in U.S. Pat. No. 6,149,486 (Thai), U.S. Pat. No. 6,331,130 (Thai) and U.S. Pat. No. 6,200,184 (Rich et al.). The bubble rings in the bubble generating assemblies in U.S. Pat. No. 6,149,486 (Thai), U.S. Pat. No. 6,331,130 (Thai) and U.S. Pat. No. 6,200,184 (Rich et al.) need to be dipped into a dish that holds bubble solution to produce films of bubble solution across the rings. The motors in these assemblies are then actuated to generate air against the films to produce bubbles.

All of these aforementioned bubble generating assemblies require that one or more bubble rings be dipped into a dish of bubble solution. In particular, the child must initially pour bubble solution into the dish, then replenish the solution in the dish as the solution is being used up. After play has been completed, the child must then pour the remaining solution from the dish back into the original bubble solution container. Unfortunately, this continuous pouring and re-pouring of bubble solution from the bottle to the dish, and from the dish back to the bottle, often results in unintended spillage, which can be messy, dirty, and a waste of bubble solution.

Thus, there is still a need for a bubble machine that provides greater variety of play and amusement, by generating a plurality of bubbles at the same time in a manner where the bubbles are emitted vertically upwardly.

SUMMARY OF THE DISCLOSURE

It is an object of the present invention to provide a bubble generating machine which automatically generates a plurality of bubbles at the same time, and in particular, where the bubbles are emitted vertically upwardly.

In order to accomplish the objects of the present invention, there is provided a bubble machine having a machine housing, a fan assembly having a fan housing that is positioned inside the machine housing, and a fan coupled to the fan housing. A bubble dispenser is disposed over the machine housing, the bubble dispenser having an outer wall having a circumferential edge that defines a trough along a portion of the circumferential edge. The bubble dispenser further includes an inner hub having a raised platform, and a bubble wand guiding mechanism provided on the platform. The outer wall and the inner hub define at least one space through which air generated by the fan can flow upwardly. A bubble wand assembly is provided that has a base and a plurality of bubble wands, each bubble wand being provided at a first end of a branch, with a second opposite end of each branch secured for pivoting movement in the base. The second end of each branch has a lever that is angled with respect to the branch. The bubble wands are disposed above the bubble dispenser in a manner such that each of the plurality of bubble wands is rotated past the trough to be coated with bubble solution, and then rotated over the at least one space so that air from below can be blown through the bubble wand to generate bubbles. A motor assembly positioned below the bubble dispenser and includes a motor for causing the fan to rotate, and for rotating the bubble wand assembly.

BRIEF DESCRIPTION OF THE DRAWINGS

FIG. 5 is an isolated exploded perspective view of the fan assembly, the wand motor assembly and the dispenser of the bubble machine of FIG. 1.

FIG. 6 is an enlarged exploded perspective view of a portion of the fan assembly of FIG. 5.

DETAILED DESCRIPTION OF THE PREFERRED EMBODIMENTS

Figure 1:
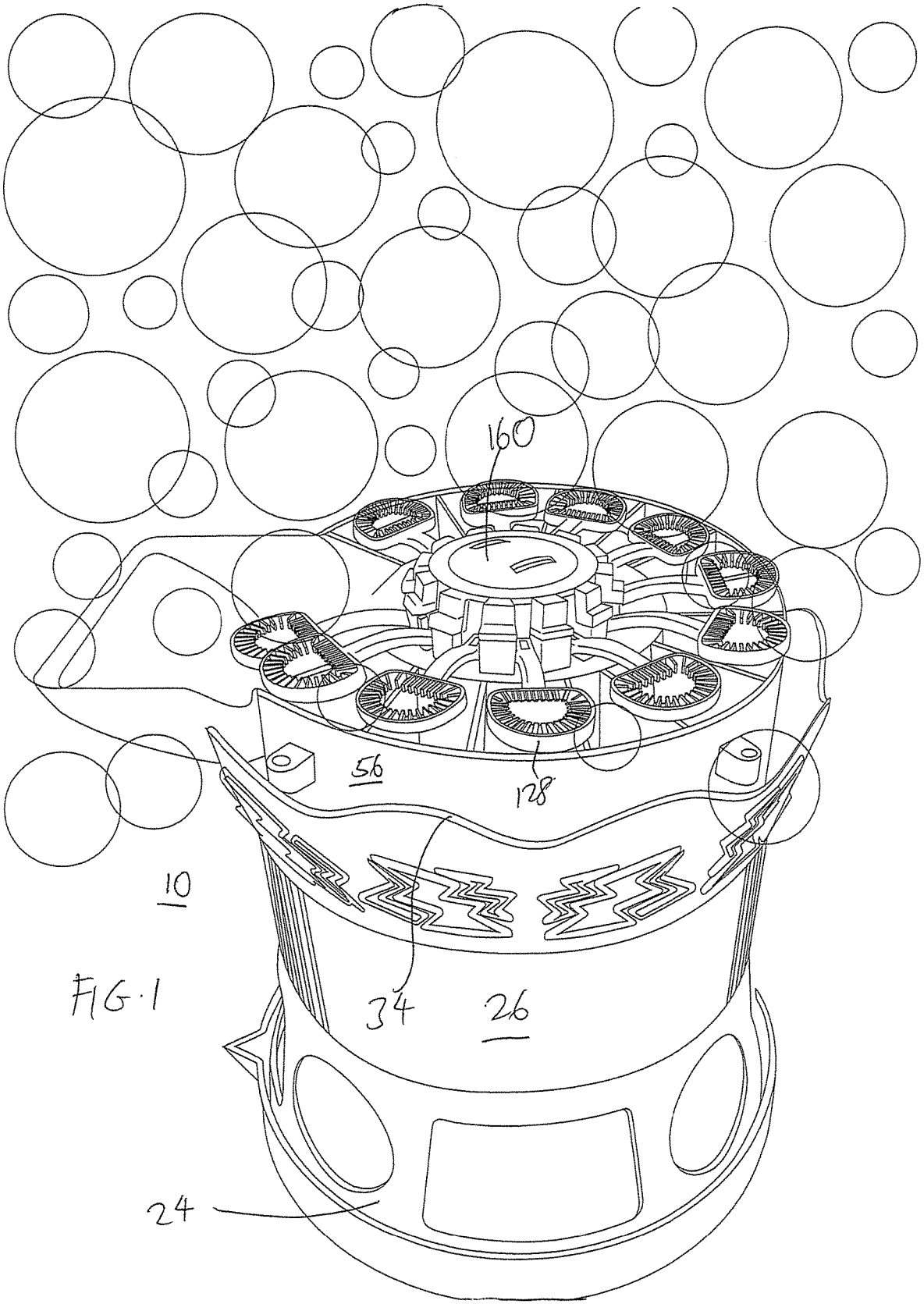
FIG. 1 is a perspective view of a bubble machine according to one embodiment of the present invention.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Referring to FIGS. 1-5, the bubble machine 10 has a bubble wand assembly 12, a bubble dispenser 13, a wand motor assembly 14, and a fan assembly 16. The wand motor assembly 14 and the fan assembly 16 are housed inside a machine housing 18. The housing 18 is seated on a base 20.

The base 20 can include a bubble solution pan (not shown) that is adapted for collecting bubble solution that has dripped from the bubble wand assembly 12, and is configured like a raised generally circular stool 24. The stool 24 is adapted to be seated inside the pan (not shown) during use. The stool 24 has a top wall 28 that has elongated curved openings extending around, with these elongated curved openings allowing bubble solution to drip therethrough.

The housing 18 includes a generally circular wall 26 that is secured to the top of the stool 24 via screws 30. A flared annular wall 32 extends from the top edge of the wall 26 in a manner such that the diameter of the flared wall 32 increases from its bottom edge to its upper edge 34. A battery and control compartment 36 is secured to the side of the housing 18, and houses batteries 38, electrical contacts 40, and switches 42 for actuating the two motors 94 and 106 described below. A plurality of LED light bulbs 44 are secured to a portion of the flared wall 32, and electrically coupled to the batteries 38 and the switches 42, for emitting light. LED light bulbs 44 can be provided in one or a variety of colors, and are optional. Wires 37 are provided to electrically connect the various electrical components to drive the motors 94 and 106 described below, and to illuminate the light bulbs 44.

Figure 2:
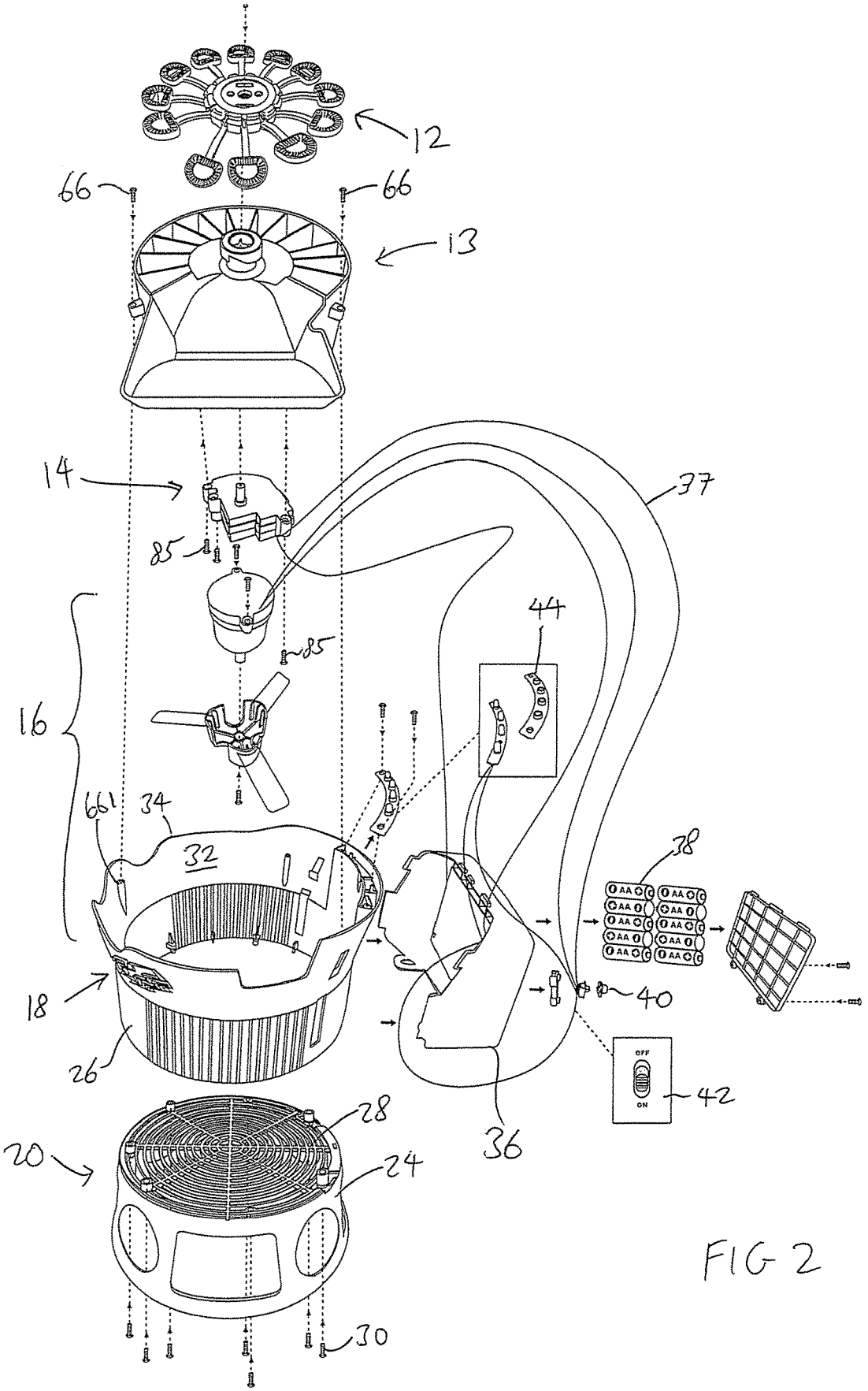
FIG. 2 is an exploded perspective view of the bubble machine of FIG. 1.

Referring to FIGS. 2, 5 and 6, the fan assembly 16 includes a fan 52 and a fan motor housing 54. The fan motor housing 54 is generally cylindrical and has a closed lower end from which a hollow shaft 84 extends. The fan motor 94 is retained inside the cylindrical body of the fan motor housing 54, and has a motor shaft 98 extending downwardly therefrom. A lid 96 seals the fan motor 94 inside the fan motor housing 54 via screws 78. In use, when the fan motor 94 is turned on, the motor shaft 98 drives the hollow shaft 84 to cause the fan 52 to rotate.

As best shown in FIG. 6, the hollow shaft 84 of the fan motor housing 54 extends downwardly into the hollow hub 86 of the fan 52. The hollow hub 86 is essentially a generally circular body defined by three curved walls 81, with three blades 88 extending radially outwardly, and has a closed bottom end 83 with a hollow tube 90 that is adapted to receive the hollow shaft 84. The hollow tube 90 has a closed end with an opening, through which a screw 92 secures the bottom of the hollow shaft 84 inside the hollow tube 90. Therefore, a portion of the fan motor housing 54 is actually received inside the hollow hub 86.

Figure 4:
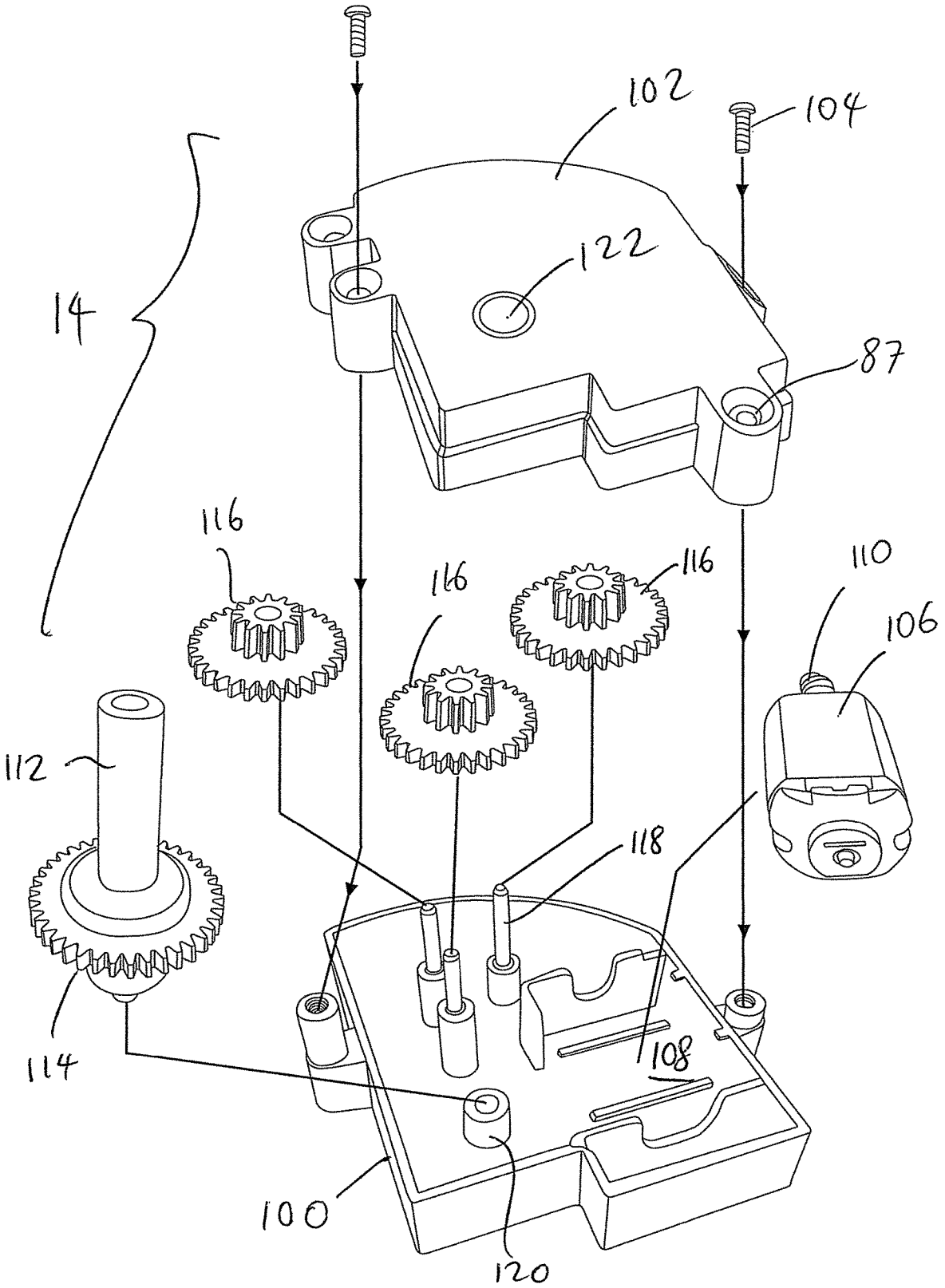
FIG. 4 is an exploded perspective view of the wand motor assembly of the bubble machine of FIG. 1.

Referring to FIG. 4, the wand motor assembly 14 has a lower housing piece 100 and an upper housing piece 102 that are secured together by screws 104 to define an interior space. A wand motor 106 is retained in a defined space 108 inside the lower housing piece 100, and a gear system is provided on the lower housing piece 100 for rotatably coupling the threaded shaft 110 of the wand motor 106 with a control gear 114. The control gear 114 has a drive shaft 112 extending vertically upwardly therefrom. The gear system can include a plurality (e.g., three) of gears 116 that are supported for rotation by three separate shafts 118 extending from the lower housing piece 100. The control gear 114 has a shaft that is seated inside a cylindrical well 120 and is adapted for rotation therein. The gears 116 and 114 all have teeth that engage teeth from adjacent gears 116/114 to translate rotation of the threaded shaft 110 into rotation of the control gear 114. The drive shaft 112 extends through an opening 122 in the upper housing piece 102, and is adapted to be coupled to the bubble wand assembly 12. The wand motor assembly 14 is adapted to be seated on top of the lid 96.

Figure 8:
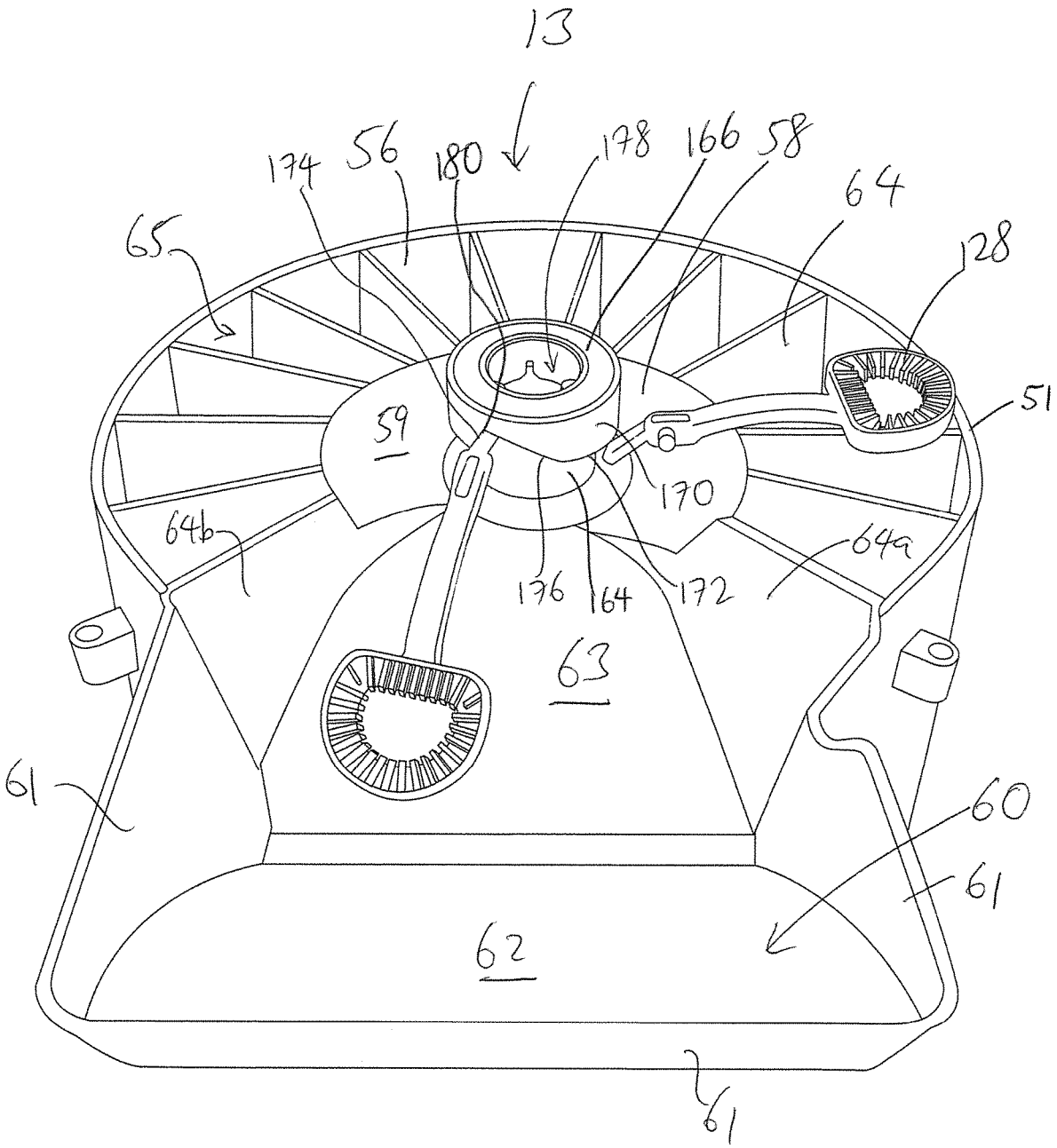
FIG. 8 illustrates the travel path of the bubble wands around the dispenser.

Referring also to FIGS. 5 and 8, the dispenser 13 has a generally circular outer wall 56 that defines a trough or well 60 along a portion of its circumferential edge 51. Bubble solution can be poured into the trough 60. A concentric generally circular inner hub 58 is provided inside the outer wall 56, and has a raised platform surface 59. A plurality of radial walls 64 extend from the annular inner wall 67 (see FIG. 6) of the inner hub 58 to the outer wall 56 and define spaces 65 between adjacent walls 64, although no radial walls 64 are provided in the trough 60. The trough 60 can be defined by one or more side walls 61 and a base wall 62 that define a sunken space that communicates with the interior of the dispenser 13. A ramped surface 63 is positioned between the two radial walls 64*a* and 64*b* that border the trough 60, and the ramped surface 63 extends from the hub 58 to the base wall 62.

As best shown in FIG. 6, an annular receiving wall 72 is provided inside the inner wall 67, and is adapted to receive the fan motor housing 54. The wand motor assembly 14 is secured inside the inner hub 58 via screws 85 (see FIG. 2) in a manner where the drive shaft 112 extends through (and is coupled to) a central hollow tube 134 in the bubble wand assembly 12. The upper portion (including the lid 96) of the fan motor housing 54 is also retained inside the inner hub 58.

Figure 3:
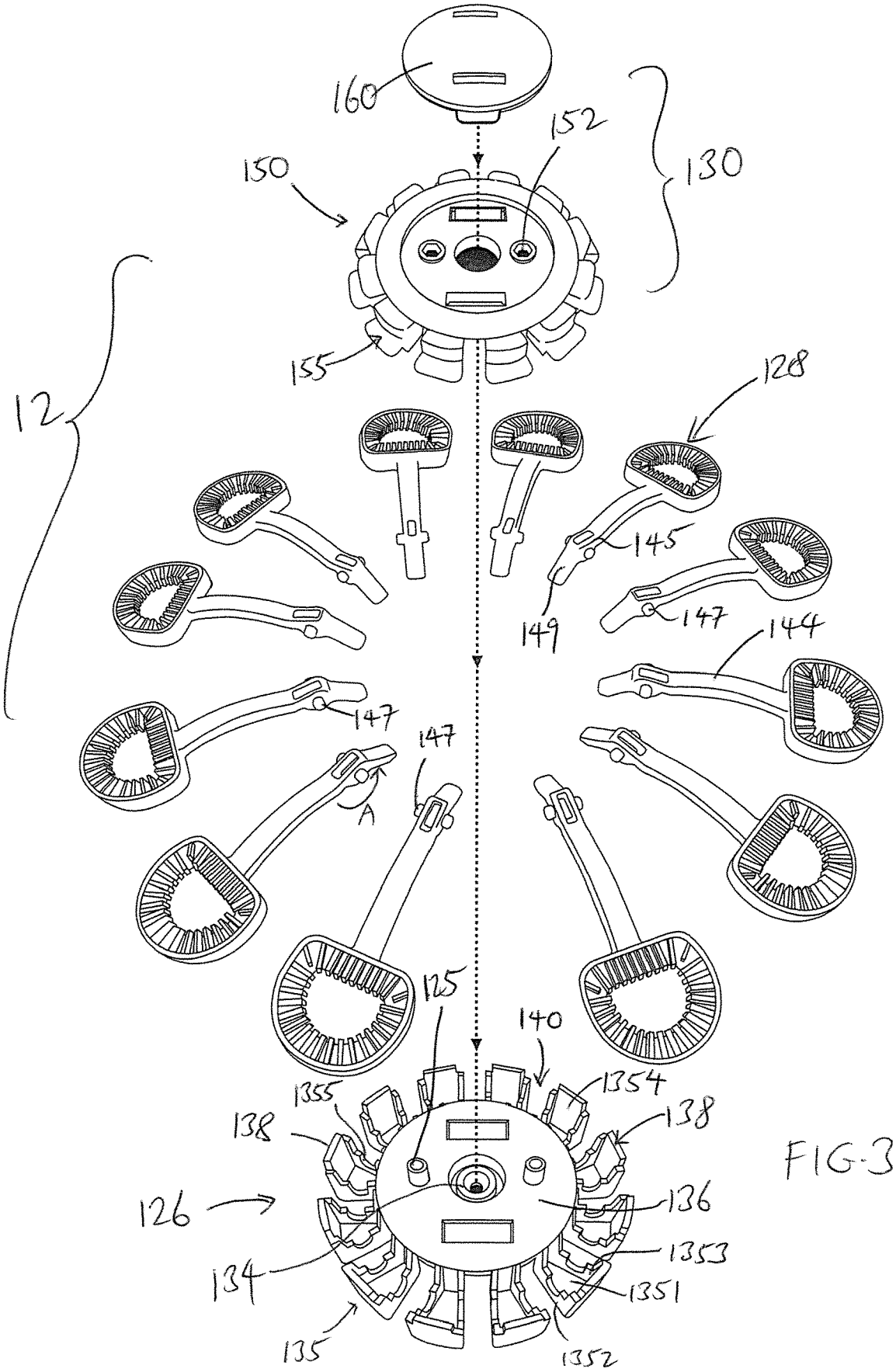
FIG. 3 is an exploded perspective view of the bubble wand assembly of the bubble machine of FIG. 1.

Referring to FIG. 3, the bubble wand assembly 12 includes a base 126, a ring of bubble wands 128, and a cap 130. The base 126 has a central raised hub 136. The base 126 has a central hollow tube 134 that receives the drive shaft 112, and a ring of pockets 135 that define a cylindrical outer serrated wall 138 which surrounds the hub 136. Each pocket 135 has a base wall 1351, two side walls 1352 and 1353 that are opposite each other, but angled radially with respect to each other, and a curved outer wall 1354 which is part of the serrated wall 138. The plurality of outer walls 1354 that define the serrated wall 138 also defines a plurality of separated open spaces 140. Semi-circular grooves 1355 are defined at the top edges of each side wall 1352 and 1353.

Figure 7:
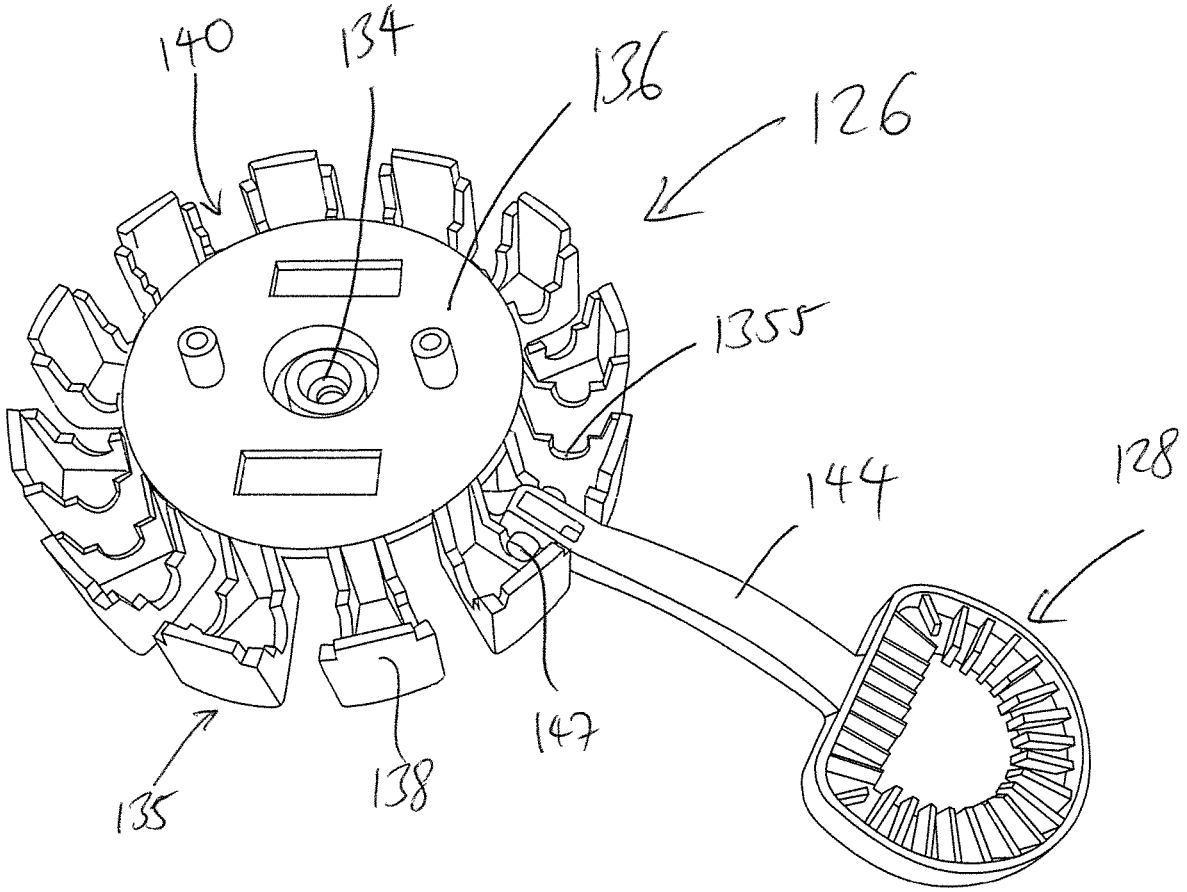
FIG. 7 illustrates how a bubble wand is pivotably coupled to the base of the bubble wand assembly.

The bubble wands 128 are arranged in annular manner to extend radially from the base 126. Each bubble wand 128 has a radial branch 144 having one end pivotably secured at a corresponding open space 140 at the base 126, and an opposite end carrying the bubble wand 128. Specifically, the inner end of each branch 144 has a pivot hub 145 having pins 147 extending from opposite sides. An angled lever 149 extends radially inwardly from the pivot hub 145 in a manner where the angle A between the lever 149 and the branch 144 is less than 180 degrees, and preferably greater than 90 degrees. Each branch 144 extends through a corresponding open space 140, with its pins 147 pivotably seated in grooves 1355 of adjacent pockets 135. This is best shown in FIG. 7.

The bubble wand 128 can have any desired shape or size, and it is possible to provide the bubble wands 128 in any combination of shapes and sizes to create any desired variety of bubbles. In this embodiment, the bubble wands 128 can all have the same size and shape. In another embodiment, the bubble wands 128 can be arranged in alternating rectangular wands and generally round wands, so that the bubble machine 10 can produce a large quantity of large and small bubbles of different shapes at the same time.

The cap 130 includes a hub piece 150 that is adapted to be secured to the base 126. The hub piece 150 has a ring of leaves 155 that can be positioned around the annular outer edge of the hub piece 150, and each leaf 155 is adapted to be aligned with a corresponding pocket 135 to cover the pocket 135. The hub piece 150 is seated on top of the base 126, and screws (not shown) can be inserted through openings 152 in the hub piece 150 to be received in cylindrical wells 125 in the base 125 secure the hub piece 150 to the base 126. A cover 160 is secured to the top of the hub piece 150.

The dispenser 13 is secured inside the housing 18 by applying screws 66 (see FIG. 2) that secure the dispenser 13 to screw wells 661 inside the housing 18. The bubble wand assembly 12 is secured for rotation on top of the bubble dispenser 13. As a result, the bubble wands 128 of the bubble wand assembly 12 are disposed in a horizontal orientation so that bubbles can be created to rise vertically. In addition, the top edge of the outer wall 56 is disposed at a higher vertical level than the upper edge 34 of the flared wall 32. This is an important feature because if the upper edge 34 is too high, this would result in fewer bubbles generated as bubbles tend to blow outwardly and upwardly, so the higher upper edge 34 would result in bubbles bouncing off the interior of the flared wall 32 and breaking.

Referring to FIGS. 8 and 9A-9C, a bubble wand guiding mechanism is provided on the platform 59, and functions to guide the branches 144 of the bubble wands 128 to travel in a circular direction around the dispenser 13, and to dip a bubble wand 128 into the trough 60 when the bubble wand 128 is positioned above the trough 60. The bubble wand guiding mechanism has a generally circular block 164 that is positioned at the center of the platform 59. A ringed cap 166 is secured at the top of the block 164 and has a diameter that is greater than the diameter than the block 166. The ringed cap 166 has a cylindrical side wall 170 having a bottom edge 172 that has a cut-out region. The cut-out region has a first angled edge 174 that extends towards the top of the ringed cap 166 at an angle, which then transitions to a second angled edge 176 that extends towards the bottom edge 172. In other words, the angled edges 174 and 176 define a V-shaped cut-out region, with the angled edge 174 being shorter than the angled edge 176. The drive shaft 112 extends through a bore (not shown) at the center of the block 164 and through the central bore 178 of the ringed cap 166 to be connected to the base 126.

Figure 9A:
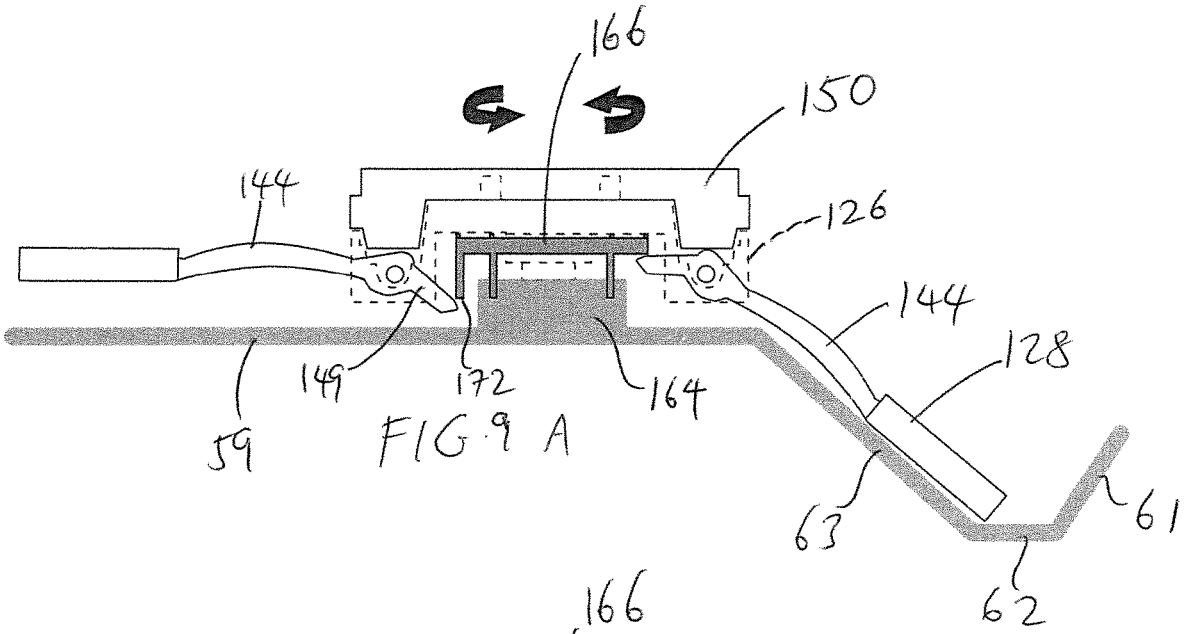
FIGS. 9A-9C illustrate three different positions along the travel path of each bubble wand.
Figure 9B:
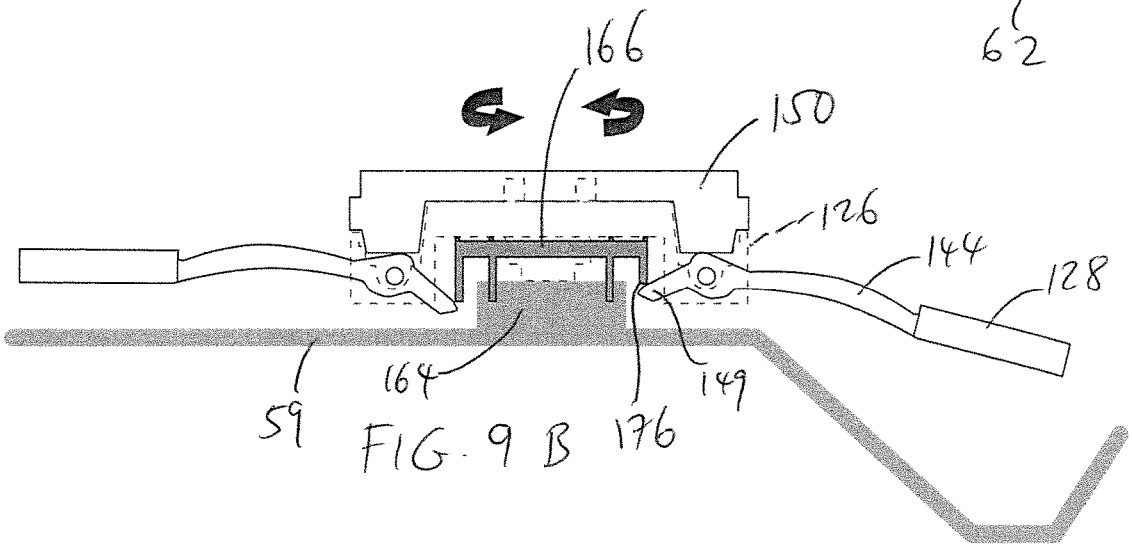
Figure 9C:
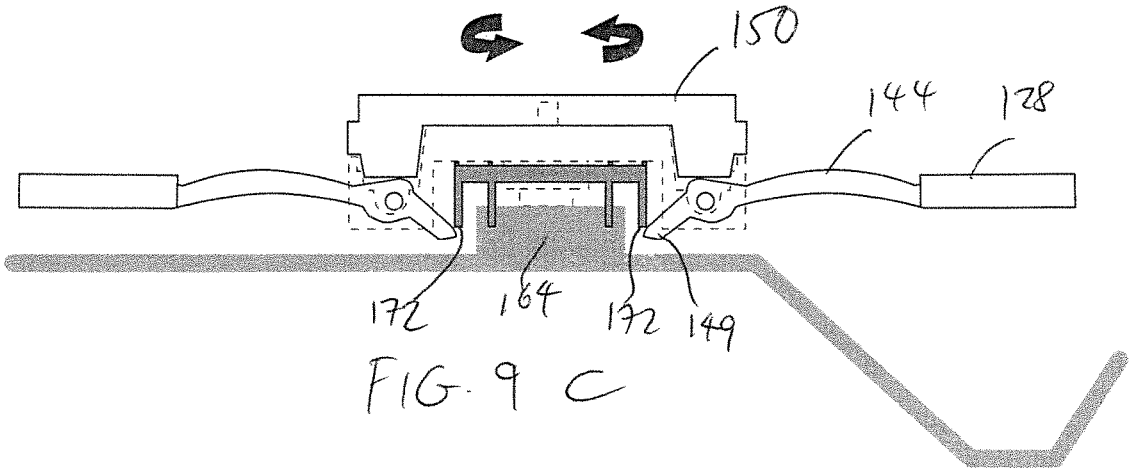

The base 126 sits on top of the ringed cap 166. The lever 149 of each bubble wand 128 is normally pressed downwardly by a portion of the bottom edge 172 of the ringed cap 166 so that the lever 149 is positioned between the bottom edge 172 of the ringed cap 166 and the platform 59. See FIGS. 8 and 9C. In this position, the branch 144 is pivoted about the pins 147 to raise the bubble wands 128. When a bubble wand 128 is rotated to travel along the bottom edge 172 until it reaches the first angled edge 174, the lever 149 will follow the first angled edge 174 until the position shown in FIGS. 8 and 9A, where the branch 144 is pivoted about the pins 147 to lower the bubble wands 128 into the bubble solution inside the trough 60. FIG. 9A shows the lever 149 at the transition point 180 between the two angled edges 174 and 176 which is also the highest point of travel for the lever 149 (and the lowest point for the bubble wand 128 inside the trough 60). As the bubble wand 128 is then rotated so that the lever 149 travels downwardly along the second angled edge 176 (see FIG. 9B), the angled edge 176 slowly raises the branch 144 until the lever 149 reaches the bottom edge 172, where the bubble wand 128 is again at the raised position shown in FIG. 9C.

Figure 10:
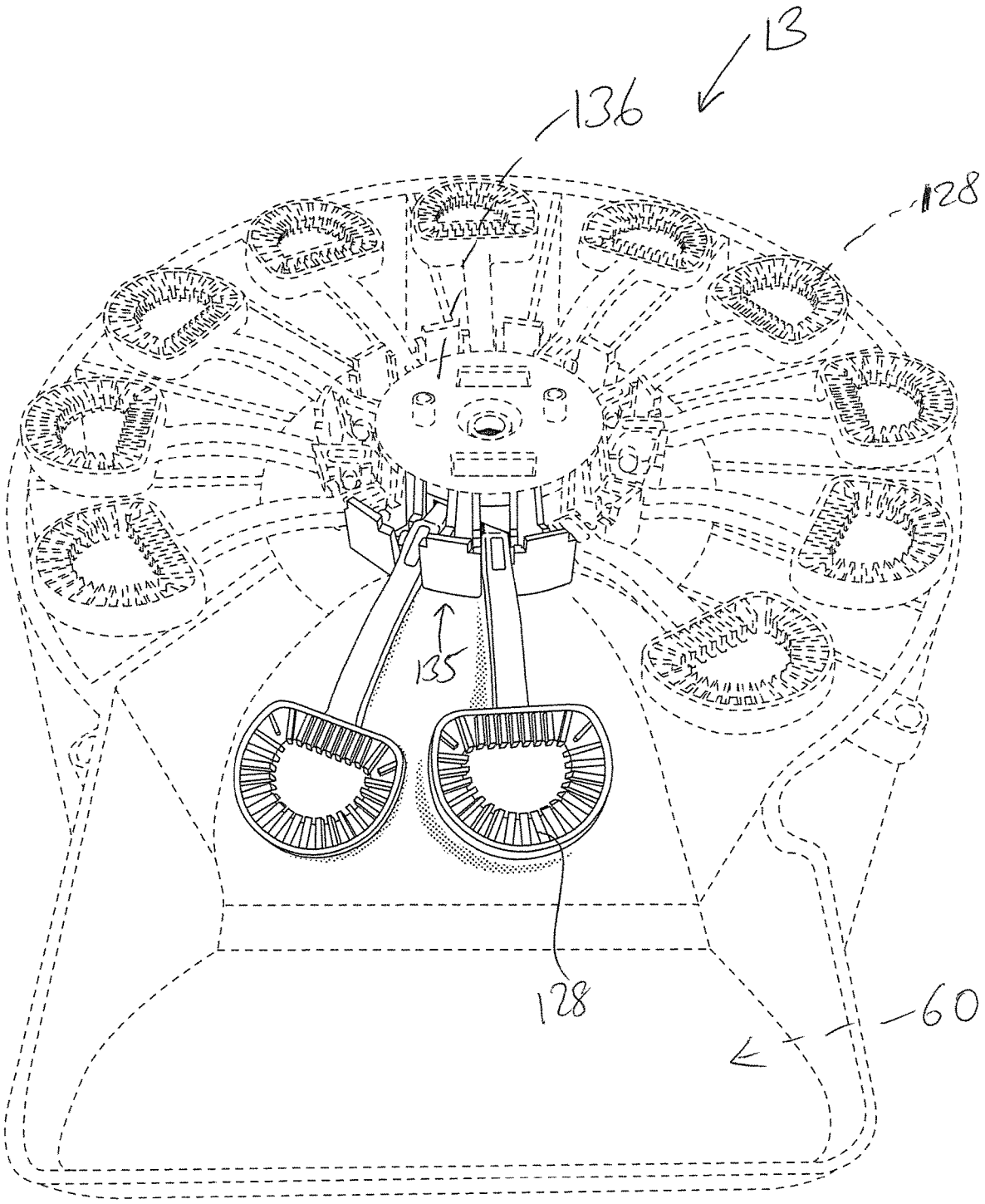
FIG. 10 shows the bubble wand assembly positioned inside and on top of the dispenser.

FIG. 10 shows the entire bubble wand assembly 12 positioned inside and on top of the dispenser 13, with two bubble wands 128 being dipped into the trough 60 and the other bubble wands 128 being raised by the bubble wand guiding mechanism.

In operation, the switch 42 is turned on, causing both motors 94 and 106 to rotate their drive shafts. The fan motor 94 causes the fan 52 to rotate, thereby generating air that is pushed through the spaces 65 between adjacent radial walls 64. The wand motor 106 causes the wand assembly 12 to rotate. As the ring of bubble wands 128 rotates, individual bubble wands 128 pass over the trough 60 and are dipped into the trough so that bubble solution is coated over the bubble wands 128. Once coated with bubble solution, the bubble wands 128 raised and rotated over the area where the radial walls 64 are positioned, so that the air created by the fan 52 and pushed through the spaces 65 between adjacent radial walls 64 will blow through the bubble wands 128 to create bubbles.

The bubble wands 128 are then rotated back over the trough 60 for more bubble solution to be coated over the bubble wands 128, and the process repeats itself until the switch 42 is turned off to stop the motors 94 and 106. Bubble solution that has dripped from the bubble wands 128 flow through the spaces 65 between the adjacent radial walls 64 and are collected at the bubble solution pan. In addition, if the light bulbs 44 are provided, then they are actuated by the switch 42 to emit lights. The emitted light can be in a single color or in multiple colors, and can be emitted together, in a flashing manner, or in any desired sequence of arrangement.

Thus, the present invention provides a bubble machine 10 that is simple in construction as it does not require a pump to deliver bubble solution to the bubble wands. In addition, the bubble machine 10 generates vertical bubbles, and can creates bubbles having different sizes, thereby increasing the entertainment value for children.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A bubble machine, comprising:

a machine housing;

a fan assembly having a fan housing that is positioned inside the machine housing, and a fan coupled to the fan housing;

a bubble dispenser disposed over the machine housing, the bubble dispenser having an outer wall having a circumferential edge defines a trough along a portion of the circumferential edge, the bubble dispenser further including an inner hub having a raised platform, and a bubble wand guiding mechanism provided on the platform, the bubble wand guiding mechanism including a circular block that is positioned on the platform, and a ringed cap secured at the top of the block, the ringed cap having a cylindrical side wall having a bottom edge that has a cut-out region, wherein the outer wall and the inner hub define at least one space through which air generated by the fan can flow upwardly;

a bubble wand assembly having a base and a plurality of bubble wands, each bubble wand being provided with a branch, a first end of the branch, and a second opposite end of the branch secured for pivoting movement in the base, and wherein the second end of the branch has a lever that is angled with respect to the branch, wherein the bubble wands are disposed above the bubble dispenser in a manner such that each of the plurality of bubble wands is rotated past the trough to be coated with bubble solution, and then rotated over the at least one space so that air from below can be blown through the bubble wand to generate bubbles; and a motor assembly positioned below the bubble dispenser and including a motor coupled to the fan for causing the fan to rotate, and for rotating the bubble wand assembly.

2. The bubble machine of claim 1, wherein the cut-out region has a first angled edge that extends towards the top of the ringed cap at an angle, which then transitions to a second angled edge that extends towards the bottom edge.

3. The bubble machine of claim 2, wherein each bubble wand assumes one of the following three positions:

a first raised position where the lever is pressed downwardly by a portion of the bottom edge of the ringed cap to pivot the branch to raise the bubble wand;

a second lowered position where the lever is at an upper end of the first angled edge to pivot the branch to lower the bubble wand into the trough; and a third partially raised position where the lever is traveling along the second angled edge to pivot the branch to partially raise the bubble wand.

4. The bubble machine of claim 1, wherein each lever is normally positioned between the bottom edge and the platform, and is positioned inside the cut-out region when the corresponding bubble wand is dipped inside the trough.

5. The bubble machine of claim 1, wherein the base of the bubble wand assembly includes a ring of pockets that define a cylindrical outer serrated wall, wherein each pocket has a base wall, two side walls that are opposite each other, but angled radially with respect to each other, and a curved outer wall which is part of the serrated wall, with a plurality of separated open spaces between adjacent curved outer walls, wherein grooves are defined in each side wall.

6. The bubble machine of claim 5, wherein the bubble wands are arranged in annular manner to extend radially through a corresponding open space, and wherein pins extend from opposite sides of each branch of each bubble wand, with the pins seated in grooves of adjacent pockets.

7. The bubble machine of claim 1, wherein an angle between the lever and the branch is less than 180 degrees.

* * * * *